United States Patent [19]

Townsend

[11] 4,038,729

[45] Aug. 2, 1977

[54] HEDDLE SELECTING AND POSITIONING APPARATUS

[75] Inventor: Franklin L. Townsend, Rockford, Ill.

[73] Assignee: Barber-Colman Company, Rockford, Ill.

[21] Appl. No.: 729,361

[22] Filed: Oct. 4, 1976

[51] Int. Cl.[2] ..... D03J 1/14
[52] U.S. Cl. ..... 28/206
[58] Field of Search ..... 28/43, 44, 45, 46

[56] References Cited

U.S. PATENT DOCUMENTS 1,188,070 6/1916 Hathaway et al. ..... 28/46

*Primary Examiner*—Louis K. Rimrodt
*Attorney, Agent, or Firm*—Robert M. Hammes, Jr.

[57] ABSTRACT

A heddle selecting and positioning apparatus for a warp drawing-in machine has a rotatable selector for alternately releasing front and rear duplex heddles and has a positioning mechanism for transporting a selected heddle to a threading position and holding the heddle in position during threading. The positioning mechanism engages the heddle above and below the heddle eye to insure proper alignment for threading.

19 Claims, 8 Drawing Figures

HEDDLE SELECTING AND POSITIONING APPARATUS

BACKGROUND OF THE INVENTION

This invention relates to heddle selecting and positioning selected heddles for drawing-in of warp threads in a drawing-in machine. More particularly, the invention relates to the selection and positioning of duplex heddles.

A set of duplex heddles consists of two banks of heddles disposed on either side of the center plane of a heddle frame. The banks of heddles are generally supported on parallel upper and lower heddle bars associated with the heddle frame, the heddle bars being common to both banks of heddles. Typically, the central portions of the heddles of one bank are disposed in front of the center plane of the heddle frame and the central portions of the heddles of the other bank are disposed behind the center plane. The front and rear heddles are alternately arranged on the heddle bars. In order to accomplish drawing the warp threads through the heddles from a group of unthreaded heddles and then successively position the selected heddles for drawing-in warp threads. A typical way to perform the selection is to provide key hole slots in the central portion of the heddles and a rotatable release key extending through the heddles and adapted to release a heddle when the key is aligned with a key hole in a heddle. A selection mechanism of this type is described in Frederick L. Wienecke's U.S. Pat. No. 3,103,056. A disadvantage of this type of selection is that it requires a separate release key for each bank of heddles. Furthermore, in some applications it is desirable to use very thin, lightweight heddles. For example, in high speed looms it is necessary to reduce the weight of the moving elements as much as possible, in order to attain efficient operation. One way to accomplish this is to use lightweight heddles. Such thin heddles are too narrow to have a key hole as previously described and thus this type of selection cannot be used.

In positioning a heddle for drawing-in after selection, a turning worm is usually employed which turns the central portion of the heddle so that the heddle eye is properly aligned for penetration by the warp drawing-in needle. Wienecke U.S. Pat. No. 3,103,056 shows a turning worm which turns a heddle and holds it against a needle guide. A problem which has been evident, particularly with thin heddles having relatively small eyes, is that it is possible to have misalignment between the heddle eye and the needle since the heddle is retained in place only below the eye. Erwin C. Kieke's U.S. Pat. No. 2,230,494 shows a mechanism which engages heddles above and below the eye with the engaging elements operating on opposite sides of the heddle. But the mechanism is such that it is possible for a heddle to move laterally with respect to at least one of the engaging elements. Also, it does not provide sufficiently positive positioning at the heddle eye to insure proper alignment between the eyes of heddles and the drawing-in needle, particularly with respect to thin heddles, which allow for only a small clearance between the needle and the walls of the heddle eye.

SUMMARY OF THE INVENTION

The heddle selecting and positioning apparatus of the invention provides a single selecting mechanism which operated on both the front and rear banks of duplex heddles which are supported in a heddle frame. A plurality of unthreaded duplex heddles are compressed against a surface of a heddle releasing means. The surface is selectively movable to release the leading compressed heddle while retaining the remaining compressed heddles so that alternately released front and rear heddles can be transported and individually positioned for drawing-in of a warp thread. Means may also be provided in association with the heddle releasing means to carry a released heddle along the heddle bar and thus assist in transporting selected heddles to the drawing-in position.

In addition, the invention provides means to engage and turn a selected heddle so that it is properly positioned for piercing of an eye in the heddle by a warp drawing-in needle. The heddle is preferably engaged above and below the heddle eye so that the heddle is retained against a needle guide so as to positively position the heddle for drawing-in. The positioning mechanism may also be provided with means to separate a released heddle from the compressed heddles to facilitate the released heddle being engaged and transported to the heddle turning means by a heddle advancing device. Further the separating means may be adapted to retain the unreleased heddles to insure that a heddle is not prematurely engaged by the heddle advancing device.

The invention provides a reliable selecting and positioning apparatus employing a selecting mechanism having simpler construction and wider application than existing mechanisms and a positioning mechanism which positions heddles for warp drawing-in more positively than heretofore accomplished by other devices. Other objects and advantages of the invention will become apparent from the following detailed description of the preferred embodiment of the invention taken in connection with the accompanying drawings.

BRIEF DESCRIPTION OF THE DRAWINGS

FIG. 4 is an end view of the heddle selecting and positioning mechanism of FIG. 4 showing the heddle locator and spacer in a heddle engaging position with a heddle positioned for warp drawing-in.

DESCRIPTION OF THE PREFERRED EMBODIMENT

Figure 1:
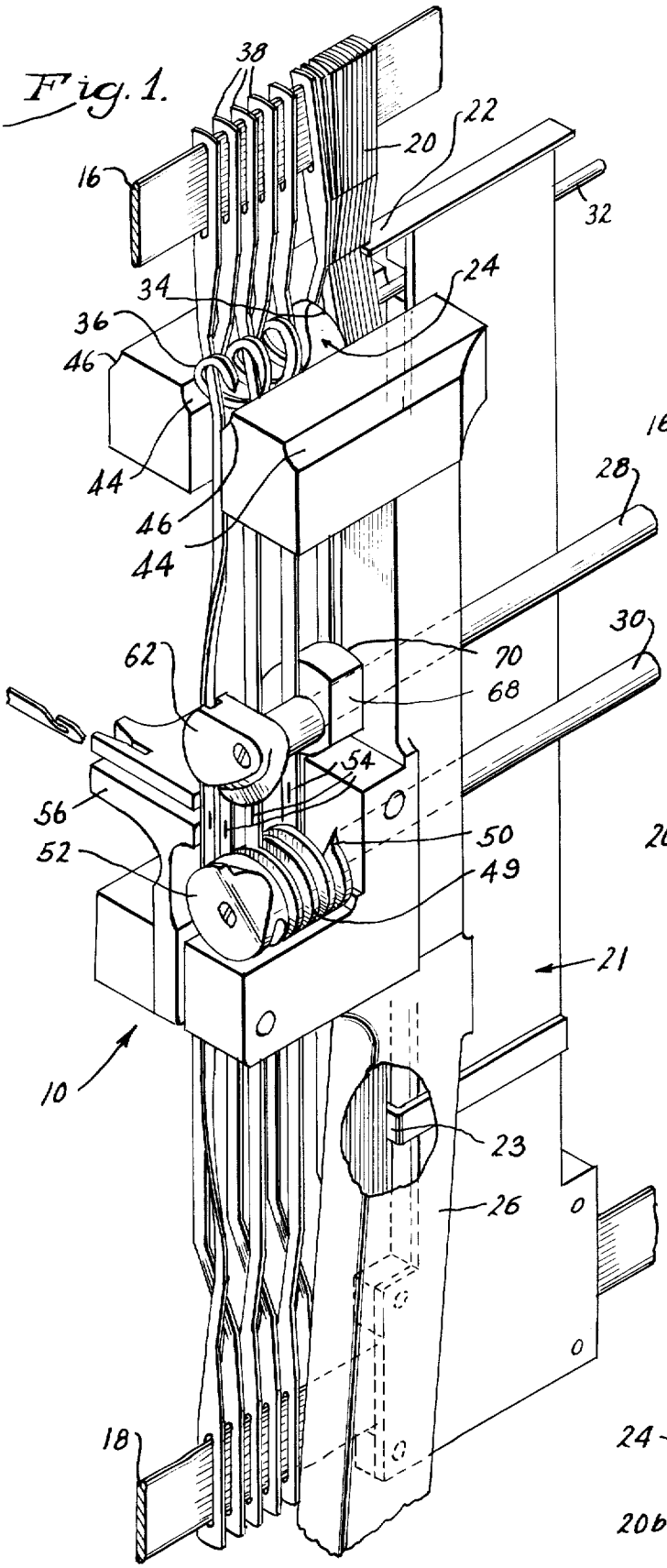
FIG. 1 is a perspective view of an embodiment of a heddle selecting and positioning mechanism according to the invention.

Referring to FIG. 1 a heddle selecting and positioning mechanism, shown generally at 10, is associated with a warp drawing-in machine (not shown)utilized to draw warp threads through the weaving elements of a loom. As is well known, a heddle frame is typically mounted on a drawing-in machine and supports the heddles to facilitate drawing-in of the warp threads. As seen in FIG. 1, upper and lower heddle bars 16, 18 support a plurality of heddles 20. Heddle bars 16, 18 typically form a part of a heddle frame and are mounted on the frame in a manner well known to those skilled in the art. Heddle backer 21 is mounted on heddle bar 18 and has an upper heddle contactor 22 and a lower heddle contactor 23 (shown in the broken out portion of FIG. 1) which compress a portion of heddles 20 against a rotatable heddle selector 24. Heddles are selectively released by selector 24 as later described. A substantially vertical support member 26 is mounted on a carriage (not shown) associated with the machine. Support member 26 supports upper and lower horizontal shafts 28, 30 which in turn carry components adapted to position selected heddles for drawing-in, as later described. During the warp drawing-in operation the carriage moves longitudinally relative to the heddle frame in a conventional manner so that heddle compression is maintained as the heddles 20 are sequentially released for drawing-in.

The novel heddle selecting mechanism of the invention can better understood by referring to FIGS. *2a, 2b, 2c* and *2d* in addition to FIG. 1. In the preferred embodiment of the invention a heddle releasing means comprises heddle selector 24 mounted on rotatable shaft 32. Selector 24 has a heddle retaining surface 34 against which heddles 20 are compressed by backer 21. As seen in FIG. *2a,* heddles 20 are comprised of alternately arranged front and rear heddles 20*a,* 20*b* slidably supported on heddle bar 16. The central portions of front heddles 20*a* are displaced in front of the center vertical plane of the heddle frame and the central portions of rear heddles 20*d* are disposed behind the center vertical plane. In FIG. *2a* heddle selector 24 is in a position whereby retaining surface 34 is in contact with the leading ones of both the front heddles 20*a* and the rear heddles 20*b.* As selector 24 rotates counter-clockwise, retaining surface 34 moves out of contact with the leading heddle of rear heddles 20*b,* reaching the position shown in FIG. *2b,* and thus releasing the leading one of heddles 20*b.* Subsequent to being released, the released or selected heddle is transported to the drawing-in position as later described. Continued counter-clockwise rotation of selector 24 brings it to the position shown in FIG. *2c* in which retaining surface 34 has moved into contact with the next heddle of rear heddles 20*b.* Upon further counter-clockwise rotation surface 34 of selector 24 moves out of contact with the leading heddle of front heddles 20*a* as seen in FIG. *2d.* Front and rear heddles are successively released in this fashion. Alternatively, selector 24 may rotate in an oscillatory fashion between the positions shown in FIGS. *2d* and *2d* to alternately release the front and rear heddles 20*a,* 20*b.*

Figure 3:
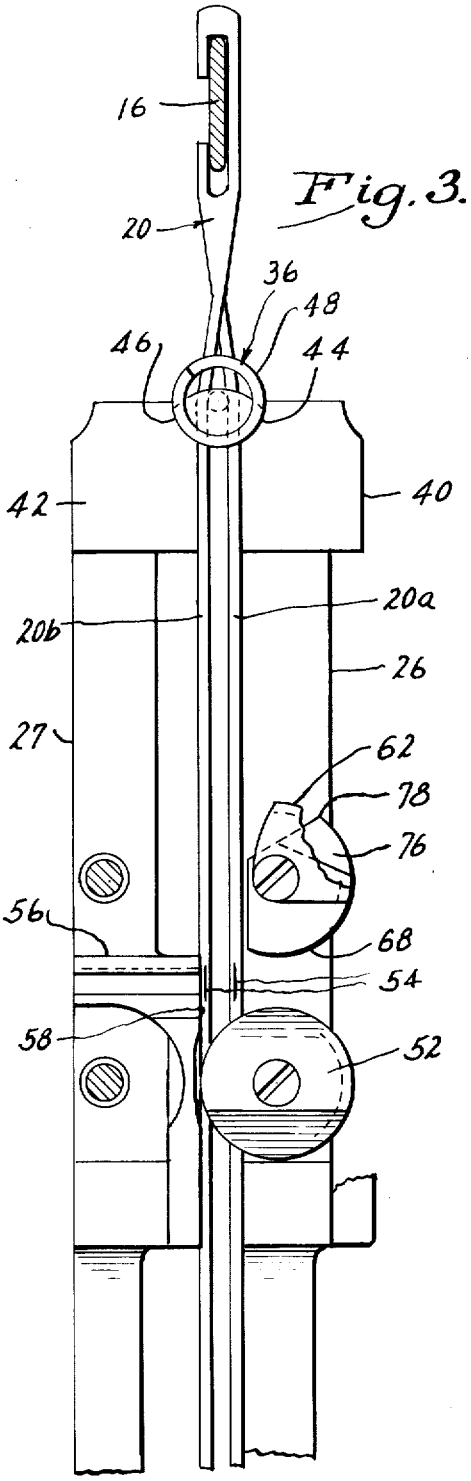
FIG. 3 is an end view of a heddle selecting and positioning mechanism showing the heddle locator and the spacer disengaged from the heddles.

In the embodiment seen in FIGS. 1 and 3, the heddle selecting means has an associated heddle transporting device adapted to move a selected heddle along heddle bar 16. The transporting device may be a rotatable member having a spiral, such as corkscrew 36, for carrying a selected heddle. While the heddle transporting device may be distinct from the heddle selecting means, corkscrew 36 is preferably connected to selector 24 so that it rotates with selector 24. After a heddle is released by selector 24 it is engaged by corkscrew 36 and transported along heddle bar 16 as corkscrew 36 rotates. This insures that released heddles 38 are evenly spaced and properly aligned during positioning and drawing-in. Shaft 32 is driven in any convenient manner and is typically supported in cantilever fashion at its driven end. Thus, it is desirable to provide support for selector 24 and associated corkscrew 36 to insure that selection occurs properly. To accomplish this, an additional support, best seen in FIGS. 1 and 3, may be provided to maintain the position of selector 24 and corkscrew 36. Front and rear bearing blocks 40, 42 are mounted on top of front and rear vertical support members 26, 27 respectively. Bearing blocks 40, 42 are provided with concave surfaces 44, 46 adjacent the circumferential surface 48 of corkscrew 36. Bearing blocks 40, 42 may be made of any suitable material such as brass or nylon. Surface 48 of corkscrew 36 may be, but need not necessarily be, in contact with concave surfaces 44, 46. It is only neccessary that concave surfaces 44, 46 be sufficiently close to surface 48 to prevent substantial downward movement of corkscrew 36 and selector 24.

Figure 4:
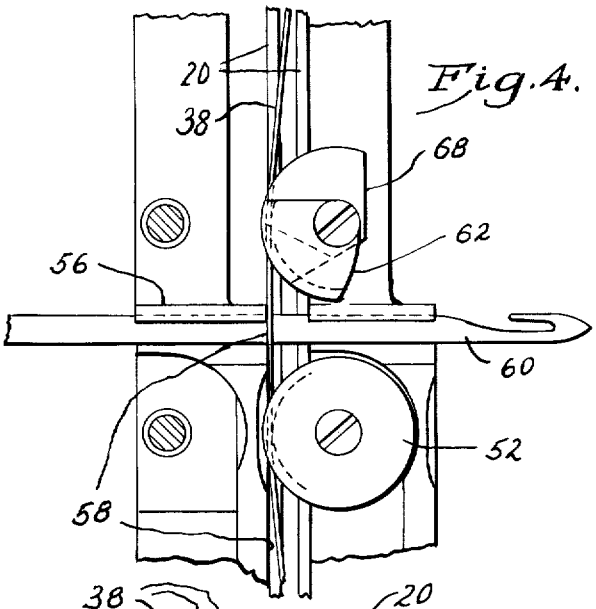
Figure 5:
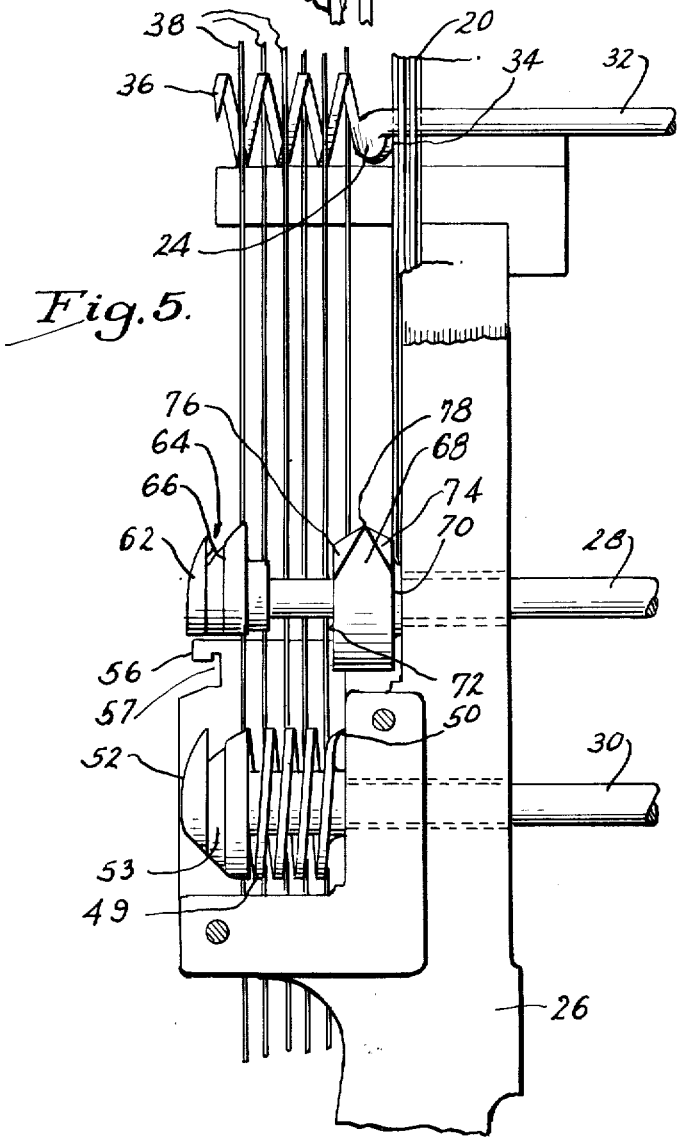
FIG. 5 is a partial front view of a heddle positioning mechanism showing how a selected heddle is transported to an advancing worm.

The positioning mechanism of the invention will now be described in greater detail. Referring to FIGS. 1 and 5, advancing worm 49 mounted on shaft 30 has a leading edge 50 adapted to engage a released heddle 38. As shaft 30 rotates advacing worm 49 transports the heddle in conventional manner to turning worm 52 which is also mounted on shaft 30. Turning worm 52 engages the heddle and turns the central portion of the heddle in a well known manner through approximately 90° so that the heddle eye 54 is in proper position for drawing-in. Needle guide 56, having a guide slot 57, is associated with rear support 27. Turning worm 52 forces the heddle against front surface 58 of needle guide 56 as best seen in FIG. 4. Once the heddle is positioned, needle 60 penetrates heddle eye 54, picks up a warp thread and draws the thread back through eye 54. When the heddle is engaged and positioned as just described it is possible for misalignment to exist between heddle eye 54 and needle 60, thus creating potential for a collision which may result in damage to both the heddle and needle 60. This is particularly true with respect to thin, lightweight heddles which provide only a small clearance between needle 60 and the walls of eye 54. In order to provide more positive positioning, the positioning apparatus of this invention has an upper locator 62 mounted on shaft 28 and disposed above turning worm 52. Locator 62 has a peripheral groove 64, best seen in FIG. 5, designed to engage a heddle for positioning. When turning worm 52 turns and positions a heddle for drawing-in locator 62 rotates counterclockwise from the position shown in FIG. 3 to the position shown in FIG. 4 thus engaging the heddle and forcing it against surface 58 of needle guide 56. Sides 66 of grooves 64 prevent lateral movement of the heddle in either direction. Front and rear movement of the positioned heddle is prevented by locator 62, turning worm 52 and surface 58. As best seen in FIG. 5, groove 64 of locator 62, guide slot 57 and retaining groove 53 of turning worm 52 are in vertical alignment with one another. Thus, the heddle is positively positioned to insure proper alignment for warp drawing-in. When a heddle is released by selector 24 it will spring away from the compacted heddles due to the compaction pressure. Sometimes a released heddle will not spring far enough to be picked up by the leading edge 50 of advancing worm 49. This is particularly true if the heddle selecting means is not provided with means to assist heddle transport such as corkscrew 36. The next released heddle of the same type 20*a* or 20*b* may be engaged by leading edge 50 at the same time as the previous heddle resulting in two heddles being carried to the drawing-in position simultaneously. In order to insure proper engagement of a released heddle by leading edge 50 of advancing worm 49 it is desirable to provide a transport-assisting spacer 68, shown in FIGs. 1, 3, 4 and 5, which is eccentrically mounted on shaft 28. According to the preferred embodiment, spacer 68 is a segment of a cylindrical solid having parallel sides 70, 72. As best seen in FIGS. 3 and 5, spacer 68 also has two surfaces 74, 76 which taper from sides 70, 72 respectively to a peripheral apex 78. When spacer 68 is in the position shown in FIGS. 1 and 4 with apex 78 pointing downward side 70 is adjacent to unreleased heddles 20 and acts to retain the heddles until they are to be transported to advancing worm 49. As spacer 68 rotates counter-clockwise it will move out of contact with the heddles thus permitting a selected heddle to move away from the unreleased heddles 20. This position is shown in FIGS. 3 and 5. As spacer 68 continues to rotate, apex 78 separates the released heddle 38 from the unreleased heddles 20 with released heddle 38 being carried along tapered surface 76 toward side 72 and subsequently into engagement with leading edge 50 of advancing worm 49. At the same time unreleased heddles 20 are forced along tapered surface 74 until they are retained by side 70. It will be apparent that spacer 68 could have numerous configurations and still accomplish this same result.

OPERATION

In the preferred embodiment, selector 24, corkscrew 36, advancing worm 49, turning worm 52, locator 62 and spacer 68 all rotate counter-clockwise intermittently. As is well-known in the art, a pattern mechanism controls the rotation of the selecting and positioning elements to bring heddles into the drawing-in position at the appropriate times. Shafts 28, 30 make one complete revolution each time a heddle is brought into the drawing-in position and released after the warp thread is drawn through the heddle-eye. Assuming a heddle has been transported by advancing worm 49 to turning worm 52, locator 62 and spacer 68 will be in the position shown in FIG. 3 and 5 out of contact with the heddles (the disengaged position). When a heddle is to be positioned for drawing-in of a warp thread, shafts 28, 30 rotate counter-clockwise one-half turn causing turning worm 52 to engage the heddle below the eye and turn it to bring the eye into proper alignment for drawing-in. Simultaneously, locator 62 engages the heddle above the eye in groove 64. The positioning elements will now be in the position shown in FIGS. 1 and 4 (the drawing-in position). Needle 60 then penetrates the heddle eye, catches a warp thread and draws it back through the eye. After the thread has been drawn-in shafts 28, 30 rotate another half turn counter-clockwise so that the heddle is released by turning worm 52 and locator 62 and moves away from the drawing-in position. Turning worm 52 and locator 62 will now be in the disengaged position once again.

Figure 2A:
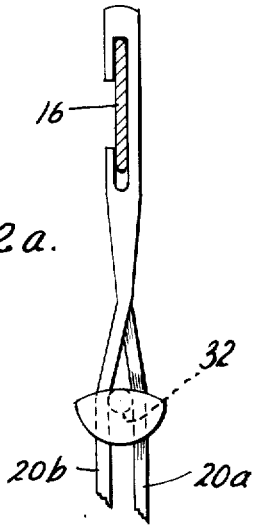
FIG. 2*a* is an end view of a heddle selecting mechanism in position to retain front and rear banks of duplex heddles
Figure 2B:
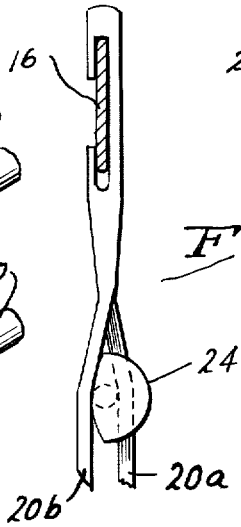
FIG. 2*b* is an end view of the heddle selecting mechanism of FIG. 2*a* in position to select a rear heddle.
Figure 2C:
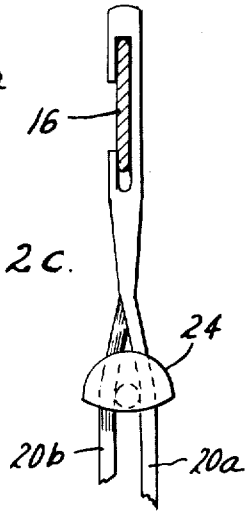
FIG. 2*c* is an end view of the heddle selecting mechanism of FIG. 2*a* in another position to retain front and rear banks of duplex heddles.
Figure 2D:
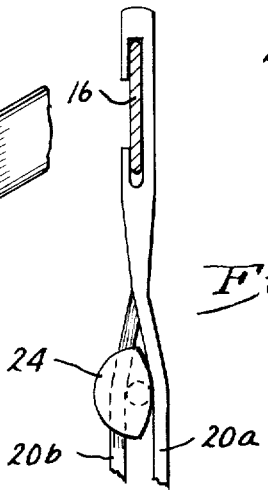
FIg. 2*d* is an end view of the heddle selecting mechanism of FIG. 2*a* in position to select a front heddle.

Heddle selector 24 releases one heddle for each half revolution. Consequently, selector 24 makes a half revolution for each complete revolution of turning worm 52 and locator 62 so that one heddle is released each time a thread is drawn-in. In the embodiment described herein selector 24 releases a heddle when turning worm 52 and locator 62 have positioned a heddle for drawing-in as shown in FIG. 1. When turning worm 52 and locator 62 are in the disengaged position, selector 24 will be in either the position shown in FIG. 2*a* or that shown in FIG. 2*c*. Assuming selector 24 is in the position shown in FIG. 2*a*, as turning worm 52 and locator 62 rotate to the drawing-in position selector 24 simultaneously rotates to position shown in FIG. 2*b* so as to release the leading rear heddle 20*b*. When turning worm 52 and locator 62 rotate to the disengaged position subsequent to drawing-in of the warp thread, locator 24 simultaneously rotates one quarter turn to the position shown in FIG. 2*c*. When the next heddle is positioned for drawing-in locator 24 rotates another quarter turn to release the leading front heddle 20*a*as shown in FIG. 2*d*.

Spacer 68 is in a heddle engaging position at the same time turning worm 52 and locator 62 are in the drawing-in position. Thus the leading heddle of compressed heddles 20 is released when side 70 of spacer 68 is in position to retain the compressed heddles 20. When spacer 68 rotates one half turn to the disengaged position shown in FIGS. 3 and 5 the released heddle will be allowed to move away from the compressed heddles 20 and selector 24 will have rotated to the position shown in either FIG. 2*a* or FIG. 2*c*. During the next one half turn of shaft 28, spacer 68 positively separates the selected heddle from the unreleased heddles 20 as previously described.

The timed relationships between the various heddle selecting and positioning elements may be varied, depending on particular designs, and different configurations and arrangements of the element of the invention can be without departing from the scope and spirit of the invention. Consequently, the invention is limited only by the claims.

I claim:

1. In a warp drawing-in frame, a duplex heddle selecting and positioning apparatus for retaining in compression against a backer mechanism a plurality of front and rear duplex heddles supported in overlapping alternate arrangement, for alternately releasing front and rear heddles, and for positioning the released heddles for drawing-in of warp strands, said apparatus comprising: a heddle releasing means having a surface for engaging the leading one of said compressed front and rear heddles, thereby retaining said heddles in compression, said surface movable to release the leading one of said front and rear duplex heddles while retaining the remaining front and rear heddles in compression.

2. Apparatus as in claim 1 additionally comprising means to transport a released heddle along the heddle bar.

3. Apparatus as in claim 2 wherein said heddle transporting means compreses a rotatable member having a spiral adapted to carry a released heddle along the heddle bar as said member rotates.

4. Apparatus as in claim 3 wherein said rotatable member comprises a corkscrew-shaped member.

5. Apparatus as in claim 1 wherein said heddle selecting means comprises an elongated member extending between the front and rear heddles and an enlarged selector associated with said member, said surface being a part of said selector.

6. Apparatus as in claim 5 wherein said selector is adapted to oscillate between the front and rear heddles so as to selectively release the leading heddle.

7. Apparatus as in claim 5 wherein said selector is rotatable in a single direction to move said surface so as to selectively release the leading heddle.

8. Apparatus as in claim 7 additionally comprising a heddle transporting member fixed to and rotatable with said selector, said heddle transporting member having a spiral adapted to carry a released heddle along the heddle bar as said heddle transporting member rotates.

9. Apparatus as in claim 8 wherein said heddle transporting member comprises a corkscrew-shaped member.

10. Apparatus as in claim 8 additionally comprising a first support bearing located in front of the front heddles and a second support bearing located behind the rear heddles, each of said first and second support bearings having a bearing surface adjacent to said heddle transporting member so as to provide support for said heddle transporting member.

11. Apparatus as in claim 10 wherein said bearing surfaces are substantially concave.

12. Apparatus as in claim 1 further comprising a rotatable turning worm having a spiral groove adapted to engage a released heddle and to turn the engaged heddle upon rotation of said turning worm such that a neddle may be passed through an eye in the turned heddle.

13. Apparatus as in claim 12 further comprising a rotatable advancing worm associated with said turning worm, said advancing worm adapted and arranged to transport a released heddle to said turning worm.

14. Apparatus as in claim 13 wherein said advancing worm and said turning worm are fixed to a common rotatable shaft.

15. Apparatus as in claim 13 further comprising an eccentrically rotatable transport-assisting spacer adapted and arranged to move a released heddle from an initial position to a second position so that the released heddle may be engaged by said advancing worm.

16. Apparatus as in claim 15 wherein said spacer has a peripheral apex for separating a released heddle from the compacted heddles upon rotation of said spacer and a retaining surface for retaining the compacted heddles following separation of the released heddle.

17. Apparatus as in claim 12 further comprising a needle guide, said turning worm adapted to hold the turned needle against said needle guide while the needle is passing through the eye.

18. Apparatus as in claim 17 further comprising a rotatable locator spaced apart from said turning worm so that the eye of the turned heddle is located between said locator and said turning worm, said locator having a peripheral groove for engaging the turned heddle and retaining the turned heddle in position while the needle is passing through the eye upon rotation of said locator.

19. Apparatus as in claim 18 wherein said locator and said turning worm are on a common side of the turned heddle, said locator adapted to retain the turned heddle against said neddle guide.

* * * * *